US009991643B2

(12) United States Patent
Takahashi

(10) Patent No.: US 9,991,643 B2
(45) Date of Patent: Jun. 5, 2018

(54) SHIELD CONNECTOR

(71) Applicant: Yazaki Corporation, Minato-ku, Tokyo (JP)

(72) Inventor: Takakazu Takahashi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/598,832

(22) Filed: May 18, 2017

(65) Prior Publication Data

US 2017/0338601 A1 Nov. 23, 2017

(30) Foreign Application Priority Data

May 19, 2016 (JP) ..... 2016-100434

(51) Int. Cl.

| | |
|---|---|
| ***H01R 13/6589*** | (2011.01) |
| ***H01R 13/40*** | (2006.01) |
| ***H01R 9/03*** | (2006.01) |
| ***H01R 13/422*** | (2006.01) |
| ***H01R 13/6592*** | (2011.01) |
| *H01R 13/50* | (2006.01) |

(52) U.S. Cl.

CPC ..... *H01R 13/6589* (2013.01); *H01R 9/032* (2013.01); *H01R 13/40* (2013.01); *H01R 13/422* (2013.01); *H01R 13/6592* (2013.01); *H01R 13/501* (2013.01)

(58) Field of Classification Search

CPC .... H01R 13/6589; H01R 9/032; H01R 13/40; H01R 13/422; H01R 13/6592

USPC ..... 439/607.08

See application file for complete search history.

(56) References Cited

U.S. PATENT DOCUMENTS 4,558,916 A * 12/1985 Hehl ..... H01R 12/675 439/374
5,322,457 A * 6/1994 Tsuji ..... H01R 13/4368 439/595
5,518,428 A * 5/1996 Onoda ..... H01R 13/4223 439/595
6,186,828 B1 * 2/2001 O'Sullivan ..... H01R 9/0518 439/579
6,783,386 B2 * 8/2004 Clement ..... H01R 13/5812 439/467

(Continued)

FOREIGN PATENT DOCUMENTS

JP 6-310199 A 11/1994
JP 10-321280 A 12/1998

*Primary Examiner* — Alexander Gilman
(74) *Attorney, Agent, or Firm* — Sughrue Mion, PLLC

(57) ABSTRACT

A shield connector includes an inner housing that includes a plurality of terminal accommodating rooms to respectively accommodate inner terminals of a shield electric wire which is formed by bundling up a plurality of electric wires, of which the inner terminals are attached to terminal parts, and covering an outer periphery of the electric wires with a coating material including a shielding material and an insulating material, and an outer terminal into which the inner housing is mounted. In the shielded connector, the inner housing are provided with the plurality of terminal accommodating rooms which are separated by a partition wall, and has two divided terminal accommodating parts which are connected in a combinable and dividable way by flexible hinge parts which are provided along edges of the partition wall.

7 Claims, 10 Drawing Sheets

(56) References Cited

U.S. PATENT DOCUMENTS

| | | | | |
|---|---|---|---|---|
| 7,713,081 | B2 * | 5/2010 | Chen | H01R 9/037 439/409 |
| 7,950,951 | B2 * | 5/2011 | Mossner | H01R 4/2433 439/470 |
| 9,028,278 | B2 * | 5/2015 | Kanda | H01R 13/6581 439/607.51 |
| 9,130,295 | B2 * | 9/2015 | Nguyen Nhu | H01R 13/447 |
| 9,257,772 | B2 * | 2/2016 | Natter | H01R 13/42 |
| 9,455,523 | B1 * | 9/2016 | Sundarakrishnamachari | H01R 13/62927 |
| 2004/0038591 | A1 * | 2/2004 | Clement | H01R 9/035 439/607.08 |
| 2007/0105442 | A1 * | 5/2007 | Gunreben | H01R 13/447 439/607.01 |
| 2010/0068927 | A1 * | 3/2010 | Ho | H01R 9/0518 439/582 |

* cited by examiner

SHIELD CONNECTOR

CROSS REFERENCE TO RELATED APPLICATION

This application is based on Japanese Patent Application No. 2016-100434 filed on May 19, 2016, the contents of which are incorporated herein by reference.

BACKGROUND

1. Technical Field

The present invention relates to a shield connector which has an inner housing provided with a plurality of terminal accommodating rooms to accommodate inner terminals respectively.

2. Background Art

Traditionally, a high frequency shielded electric wire is used to transmit high frequency electric signals to a control unit of various electric components such as a car navigation that is installed in a vehicle.

The shielded electric wire has such a structure that the outer periphery of an insulation coating that coats the outer periphery of a conductor part made of conductive material is covered with a shielding layer, and the shielded electric wire enables high frequency propagation since the shielding placed on the exterior surface cuts off the electrical influence from outside.

A shielded connector is used for the electric connection of the shielded electric wire. The shielded connector has an inner housing provided with a plurality of terminal accommodating rooms to respectively accommodate inner terminals of the shielded electric wire which is formed after a plurality of electric wires, whose terminal parts the inner terminals are attached to, are bundled up by covering the outer periphery with a coating material including a shielding material and an insulating material, and an outer terminal into which the inner housing is mounted.

It is described in JP-A-H06-310199 that a shielded connector has a terminal housing (inner housing) provided with a plurality of terminal accommodating rooms to respectively accommodate terminals (inner terminals) of a shielded wire harness (shielded electric wire) which is formed after a plurality of electric wires, whose terminal parts the terminals (inner terminals) are attached to, are bundled up by covering the outer periphery with a coating material including a shielding material and an insulating material, and an inner pipe (outer terminal) of a housing cover into which the terminal housing (inner housing) is incorporated.

It is described in a JP-A-H10-321280 that connector is accommodated in an inner housing while terminal metal fittings (inner terminals) which are attached to terminal parts of a plurality of electric wires, respectively, are held by a holder.

However, with the shielded connector described in JP-A-H10-321280 or the connector described in JP-A-H06-310199, for the shielded electric wire made by bundling up the plurality of electric wires and coating the outer periphery with the shielding material such as web and the coating material such as insulation coating material, when the exposed portions of the plurality of electric wires at the terminal part of the shielded electric wire are short, in other words, when the removed area of the coating material at the terminal part of the shielded electric wire is small or when there are many electric wires, there is a problem that the work to set the terminals in the terminal accommodating rooms of the inner housing becomes complicated, and, as a result, productivity decreases.

The present invention is made in view of the above, and is intended to provide a shielded connector so that productivity can be improved.

SUMMARY (1) According to an aspect of the invention, a shielded connector includes:

an inner housing that includes a plurality of terminal accommodating rooms to respectively accommodate inner terminals of a shield electric wire which is formed by bundling up a plurality of electric wires, of which the inner terminals are attached to terminal parts, and covering an outer periphery of the electric wires with a coating material including a shielding material and an insulating material; and an outer terminal into which the inner housing is mounted.

In the shield connector, the inner housing are provided with the plurality of terminal accommodating rooms which are separated by a partition wall, and has two divided terminal accommodating parts which are connected in a combinable and dividable way by flexible hinge parts which are provided along edges of the partition wall.

In a combined state of the two divided terminal accommodating parts, the two divided terminal accommodating parts hold the partition wall in between, and terminal setting surfaces, on which terminal setting openings for setting the inner terminals in the plurality of terminal accommodating rooms, are overlapped through the partition wall so that the plurality of terminal accommodating rooms are sectioned by walls including the partition wall, and in a divided state of the two divided terminal accommodating parts, the partition wall stands up against the terminal setting surfaces while the terminal setting surfaces are faced in the same direction, and the plurality of terminal accommodating rooms are placed in such a way that the terminal setting openings are aligned in a row.

(2) In the shielded connector of (1), the plurality of terminal accommodating rooms are provided with primary locking projections which abut on the inner terminal so as to prevent the inner terminals accommodated inside the terminal accommodating rooms from deviating from the terminal accommodating rooms through the terminal setting openings.

(3) In the shielded connector of (1) or (2), the partition wall is provided with a plurality of secondary locking projections which abut on the inner terminals so as to prevent the inner terminals accommodated in the plurality of terminal accommodating rooms from being deviating from the electric wire insertion ports, into which the electric wires are inserted, of the terminal accommodating rooms while the two divided terminal accommodating parts are combined.

(4) In the shielded connector of (1), (2) or (3), the terminal setting openings are openings which continue from the inner sides of front end walls of walls thrilling the terminal accommodating rooms to the electric wire insertion ports into which the electric wires are inserted.

For the two divided terminal accommodating parts of the shielded connector according to the configuration (1), the partition wall stands up against the terminal setting surfaces while the terminal setting surfaces are faced in the same direction, and the plurality of terminal accommodating rooms are placed in such a way that the terminal setting openings are aligned in a row. Thus, because the plurality of inner terminals can be set respectively in the terminal accommodating rooms from one direction in which the terminal setting surfaces are directed, the inner terminals can be easily set in the terminal accommodating rooms respectively only by slightly bending the plurality of electric wires. As a result, productivity can be improved.

For the shielded connector according to the configuration (2), the primary locking projections are abutted against the Inner terminals to prevent that the inner terminals accommodated inside the terminal accommodating rooms rise from the terminal setting openings and are removed from the terminal accommodating rooms. Thus, even if the divided terminal accommodating parts are moved through the hinge parts while the sides of the terminal setting surfaces are opened, the inner terminals can be held stably in the terminal accommodating rooms.

For the shielded connector according to the configuration (3), while the two divided terminal accommodating parts are combined, the inner terminals accommodated in the plurality of terminal accommodating rooms are prevented from being removed from the electric wire insertion ports of the terminal accommodating rooms by the plurality of secondary locking projections which the partition wall is provided with. Thus, even if an external force is burdened to pull the electric wires, the inner terminals can be stably held in the terminal accommodating rooms. In addition, in a series of works of assembling the shielded connector in which the two divided terminal accommodating parts are combined, the inner terminals can be collectively locked in the plurality of terminal accommodating rooms by the plurality of secondary locking projections.

For the shielded connector according to the configuration (4), because the terminal setting openings are continuously opened from the inner sides of the front end walls to the electric wire insertion ports, the inner terminals can be more easily set respectively in the terminal accommodating rooms without bending the electric wires.

DETAILED DESCRIPTION OF EMBODIMENT

A preferred embodiment of a shielded connector according to the present invention will be described in detail with reference to the figures as follows.

Figure 1A:
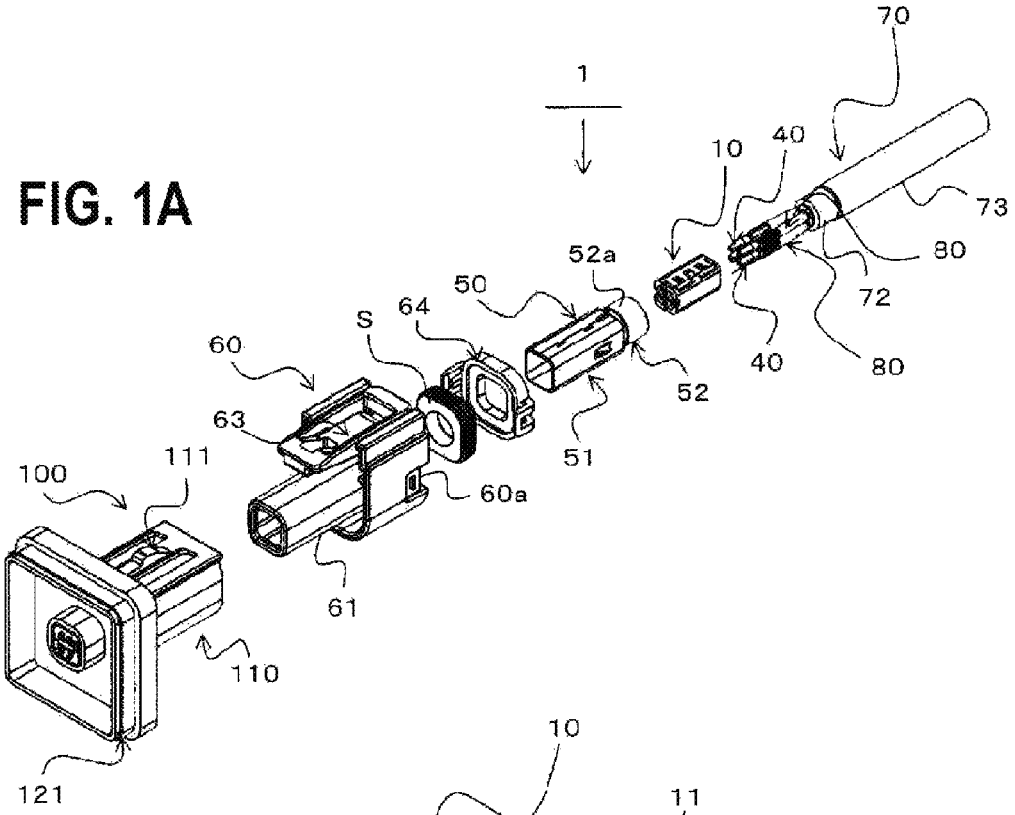
FIG. 1A is an exploded perspective view of a shielded connector according to an embodiment of the present invention and a figure which shows a mating connector which becomes a connection mate of the shielded connector.
Figure 1B:
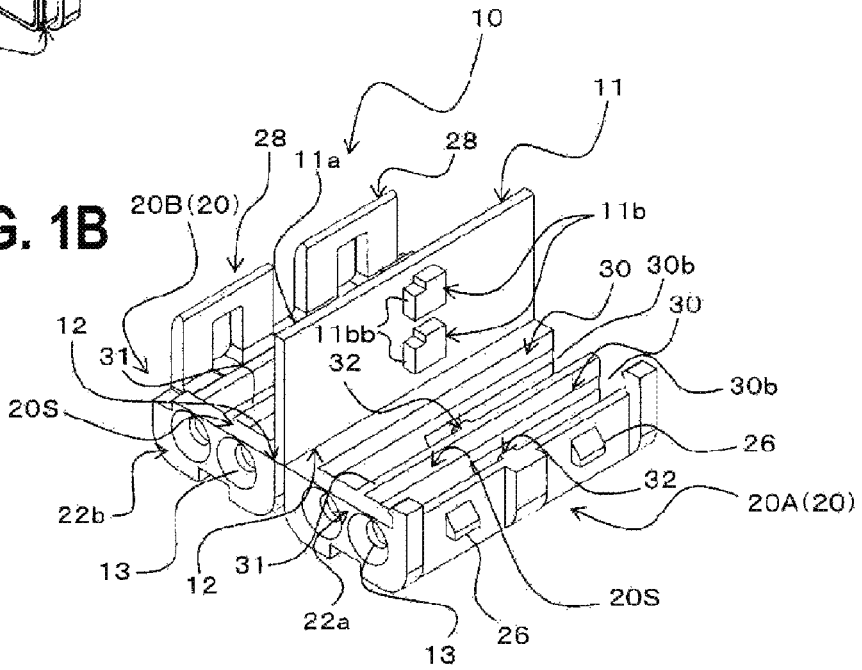
FIG. 1B is a figure which shows that an inner housing shown in FIG. 1A is divided.
Figure 2A:
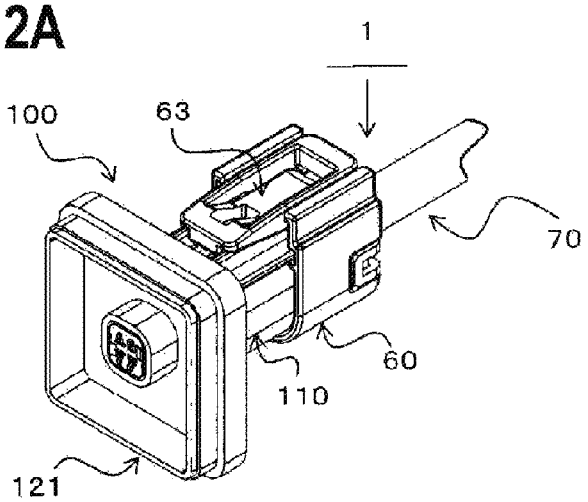
FIG. 2A is a perspective view while the shielded connector and the mating connector are engaged, and, FIG. 2B is a top view of the figure shown in FIG. 2A.
Figure 2B:
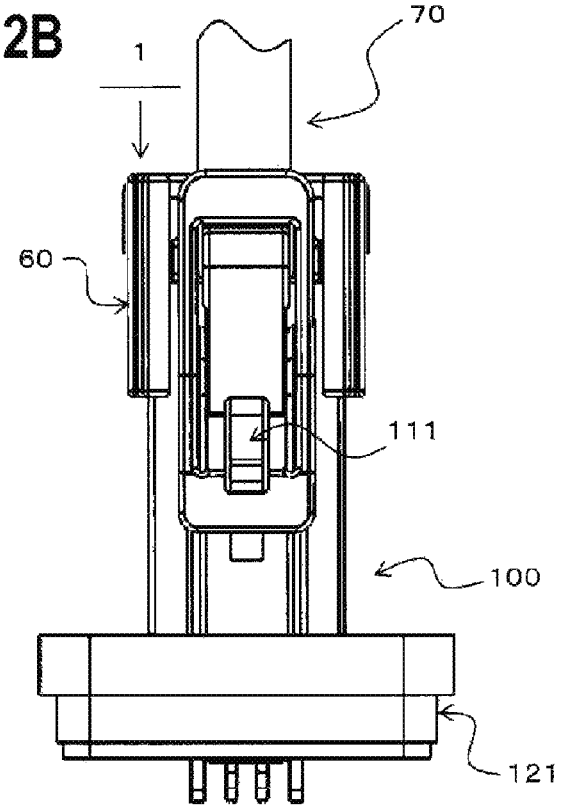
Figure 3A:
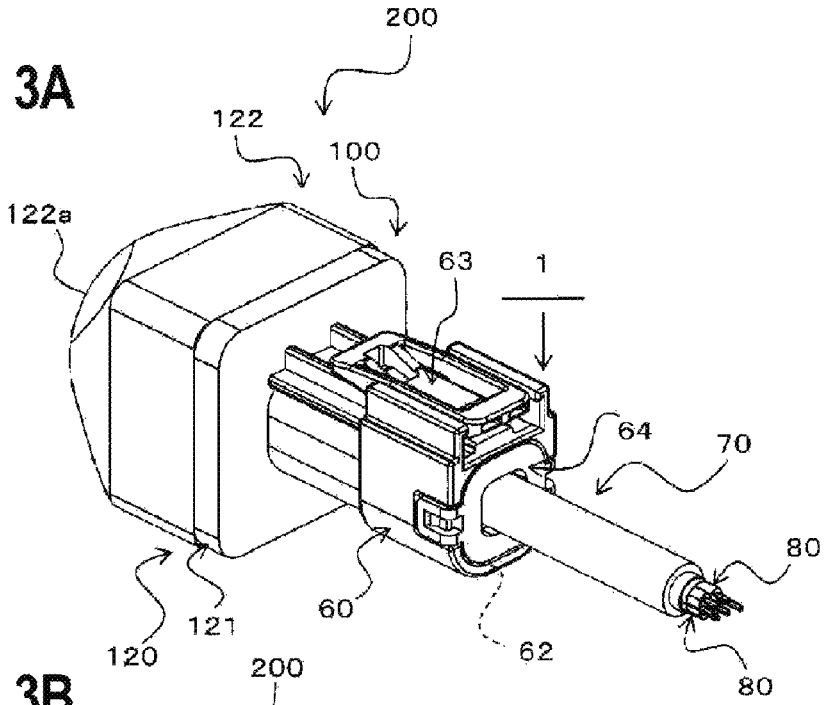
FIG. 3A is a perspective view of an in-vehicle camera which is constructed by engaging the shielded connector and the mating connector.
Figure 3B:
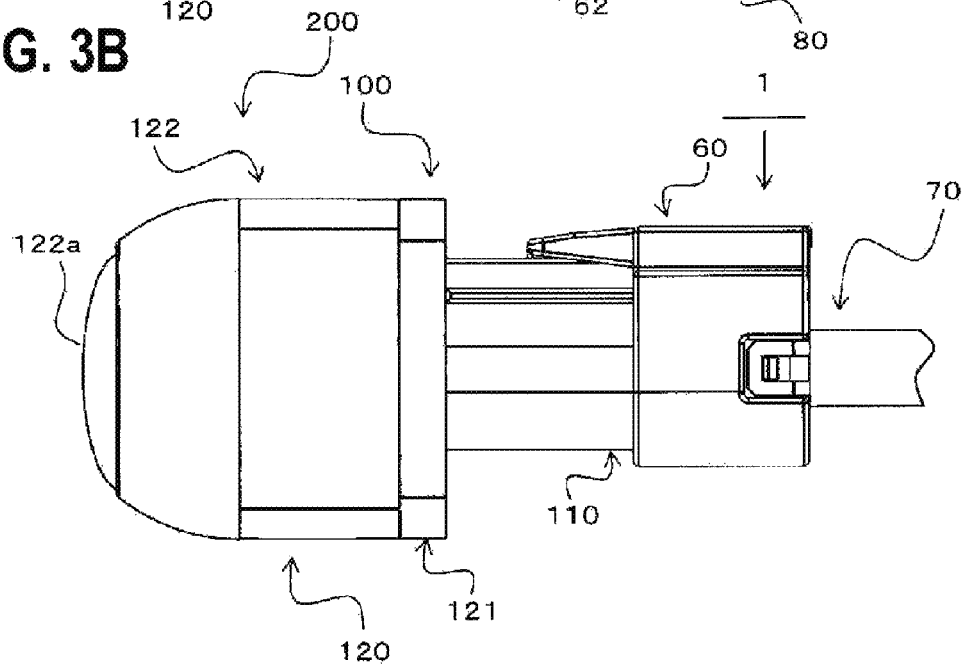
FIG. 3B is a side view of the in-vehicle camera shown in FIG. 3A.
Figure 4A:
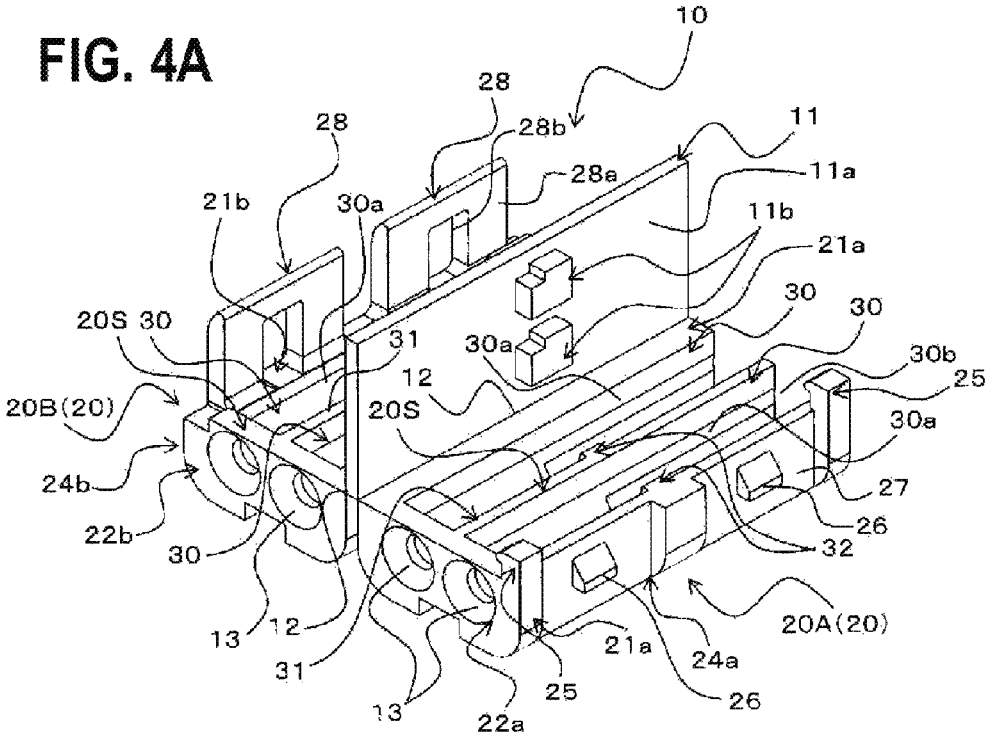
FIG. 4A is a perspective view of the inner housing in a divided state.
Figure 4B:
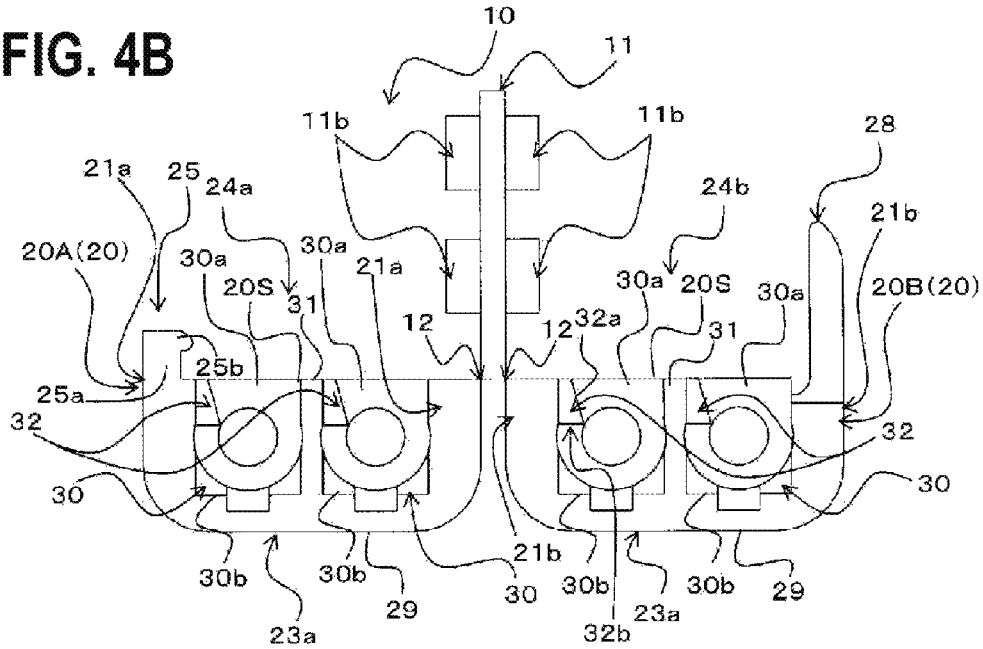
FIG. 4B is a back view of the inner housing shown in FIG. 4A.
Figure 5A:
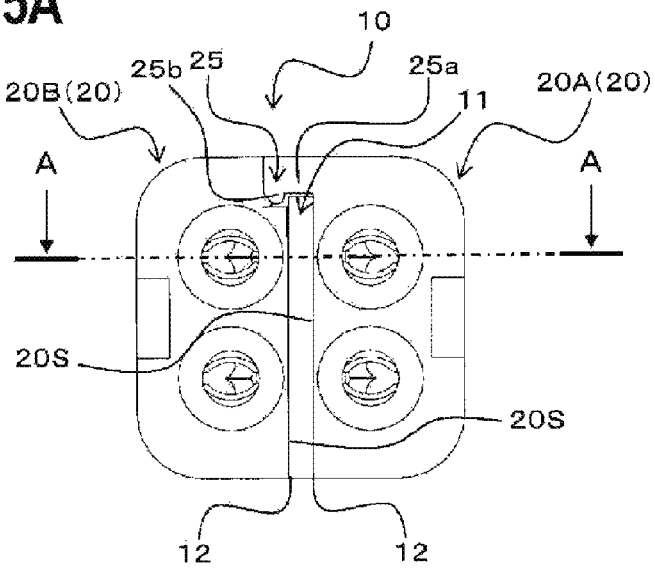
FIG. 5A is a front view of the inner housing in a combined state.
Figure 5B:
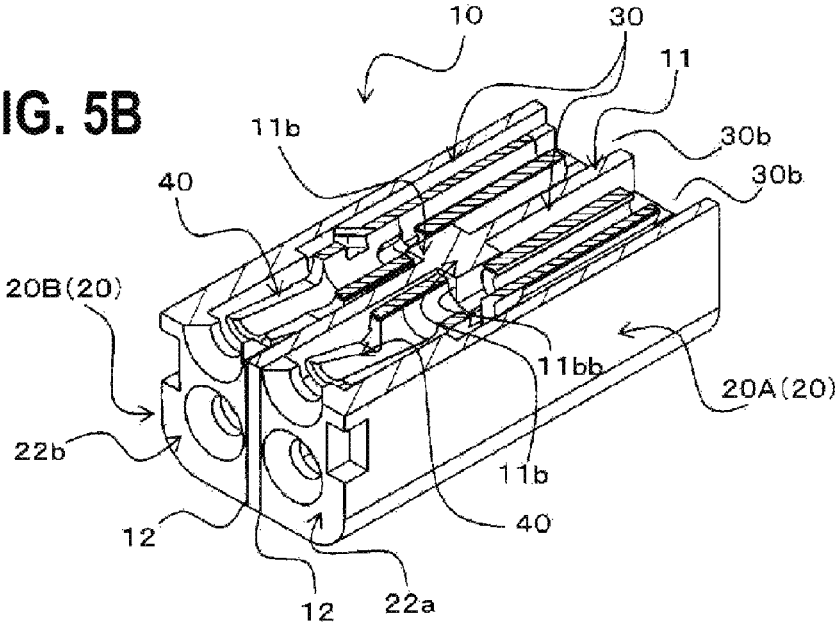
FIG. 5B is an A-A line sectional view of the inner housing shown in FIG. 5A.
Figure 6:
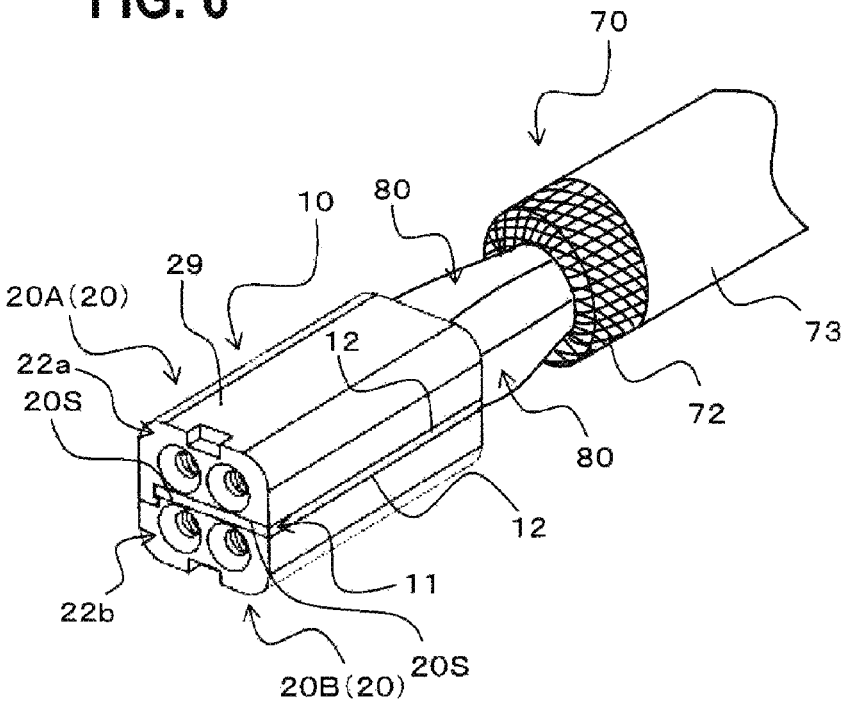
FIG. 6 is a perspective view of the inner housing while inner terminals, which are attached to terminal parts of electric wires of a shielded electric wire, are accommodated.
Figure 7A:
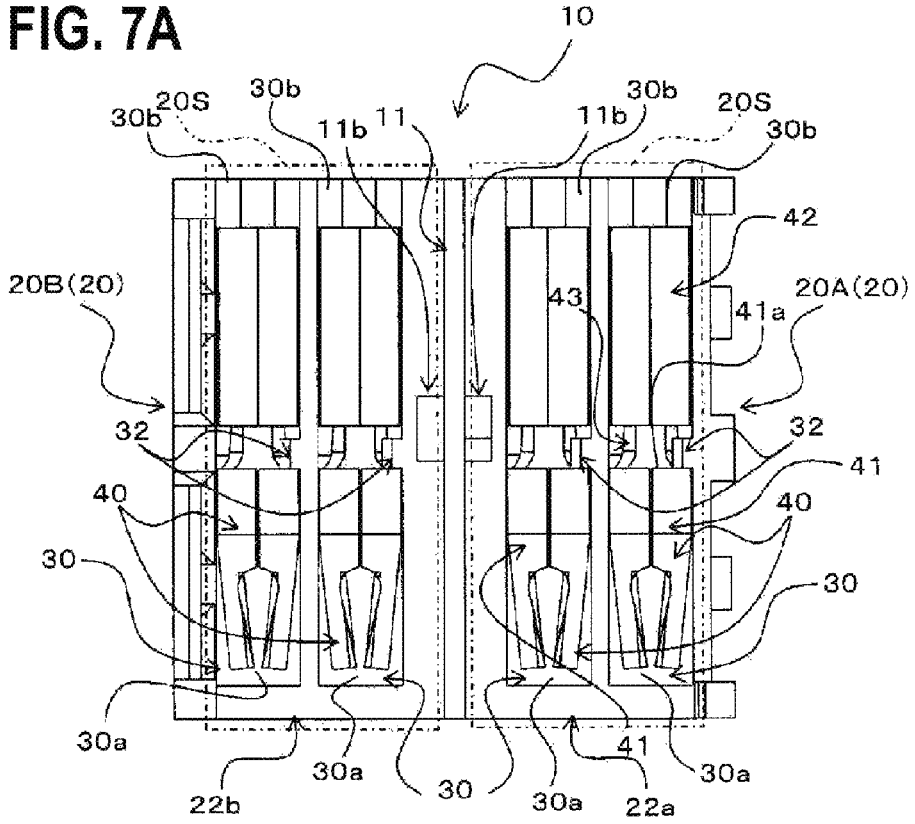
FIG. 7A is a figure which shows that the inner terminals are accommodated in the divided inner housing.
Figure 7B:
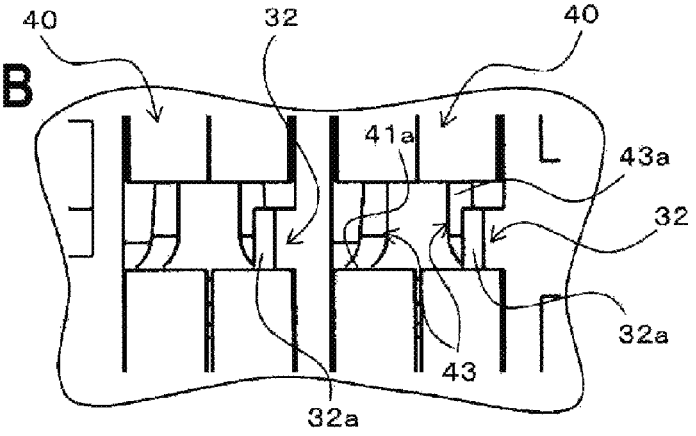
FIG. 7B is an enlarged figure which shows an area around primary locking projections of the inner housing shown in FIG. 7A.

FIG. 1A is an exploded perspective view of a shielded connector 1 according to an embodiment of the present invention and a figure which shows a mating connector 100 which becomes a connection mate of the shielded connector 1, and FIG. 1B is a figure which shows that an inner housing 10 shown in FIG. 1A is divided. FIG. 2A is a perspective view while the shielded connector 1 and the mating connector 100 are engaged, and FIG. 2B is a top view of the figure shown in FIG. 2A. FIG. 3A is a perspective view of an in-vehicle camera 200 which is constructed by engaging the shielded connector 1 and the mating connector 100, and FIG. 3B is a side view of the in-vehicle camera 200 shown in FIG. 3A. FIG. 4A is a perspective view of the inner housing in a divided state, and FIG. 4B is a back view of the inner housing 10 shown in FIG. 4A. FIG. 5A is a front view of the inner housing 10 in a combined state, and FIG. 5B is an A-A line sectional view of the inner housing 10 shown in FIG. 5A. FIG. 6 is a perspective view of the inner housing 10 while inner terminals 40, which are attached to terminal parts of electric wires 80 of a shielded electric wire 70, are accommodated. FIG. 7A is a figure which shows that the inner terminals 40 are accommodate the divided inner housing 10, and FIG. 7B is an enlarged figure which shows an area around primary locking projections 32 of the inner housing 10 shown in FIG. 7A.

In FIGS. 1A to 2B, a camera cover part 122 of the mating connector 100 is removed so that a component mounting part 121 can be seen.

The shielded connector 1 according to the embodiment of the present invention is used, for example, for the electrical connection of an in-vehicle camera.

Therefore, as shown in FIGS. 3A and 3B, the shielded connector 1 forms the in-vehicle camera when being engaged with the mating connector 100 in which a camera function part not shown is accommodated.

The shielded connector 1 has the inner housing 10 provided with a plurality of terminal accommodating rooms 30 to respectively accommodate the inner terminals 40 of the shielded electric wire 70 which is formed after a plurality of electric wires, whose terminal parts the inner terminals 40 are attached to, are bundled up by covering the outer periphery with a coating material including a shielding material and an insulating material, an outer terminal 50 into which the inner housing 10 is mounted, and a connector housing 60 which receives the outer terminal 50, and is provided with a connector fitting portion to fit the mating connector 100.

The shielded electric wire 70 is so constructed four electric wires 80 are covered with multilayered coating material.

More specifically as shown in FIGS. 8A to 8F, the shielded electric wire 70 is so constructed that the four electric wires 80 are covered with a metal foil 71 to be bundled up, the outer periphery of the metal foil 71 is further covered with a web 72 knitted with a conductive material, and the outer periphery of the web 72 is further covered with an insulating coating material 73.

For this shielded electric wire 70, the four electric wires 80 are exposed at the terminal parts, and the inner terminals 40 are crimped to the exposed terminal parts of the four electric wires 80.

The inner terminal 40 is a female terminal, and, as shown in FIG. 7, has a pipe-like mating terminal connecting part 41 to which a male terminal to be described of the mating connector 100 is connected, a crimped part 42 crimped to the electric wire 80, and a tying part 43 to tie the mating terminal connecting part 41 and the crimped part 42 so that the bottom walls continue.

The inner housing 10 is made of an insulating resin material, and the four terminal accommodating rooms 30 are provided in a divided way with a partition wall 11 in between. Further, the inner housing has two divided terminal accommodating parts 20 which are connected in a combinable and dividable way by hinge parts 12 which are provided along the edges of the partition wall 11 and have flexibility.

In a combined state, the two divided terminal accommodating parts 20 hold the partition wall 11 in between, and terminal setting surfaces 20S, which are surfaces where terminal setting openings 30*a*, which enable the setting of the inner terminals 40 into the four terminal accommodating rooms 30 are provided, are overlapped so that the four terminal accommodating rooms 30 are sectioned by walls including the partition wall 11. In a divided state, the partition wall 11 stands up against the terminal setting surfaces 20S while the terminal setting surfaces 20S are faced in the same direction, and the terminal accommodating rooms 30 are placed in such a way that the terminal setting openings 30*a* are aligned in a row.

Below, for convenience, when the two divided terminal accommodating parts 20 are distinguished, one is referred to as a first divided terminal accommodating part 20A, and the other is referred to as a second divided terminal accommodating part 20B.

The divided terminal accommodating parts 20 have a pair of side walls 21*a*, 21*b*, front end walls 22*a*, 22*b*, and bottom walls 23*a*, 23*b*, and further have main body portions which are formed of substantially box-like divided main bodies 24*a*, 24*b* whose surfaces at the sides that become the terminal setting surfaces 20S and electric wire insertion ports 30*b* are open.

The upper end corners of the side walls 21*a*, 21*b* of the two divided main bodies 24*a*, 24*b* of the two divided terminal accommodating parts 20 are connected along two corners of one end of the partition wall 11, and the connecting portions become the hinge parts 12.

The first divided terminal accommodating part 20A is provided with two locking claw parts 25, 25 for locking the partition wall 11 at the side wall 21*a* to which the hinge part 12 is not connected, among the pair of side walls 21*a*, 21*a* of the divided main body 24*a*, and two locking projections 20, 26 the engaging respectively with two locking arms 28, 28 described below of the second divided terminal accommodating part 20B while the first divided terminal accommodating part 20A is combined with the second divided terminal accommodating part 20B.

The two locking claw parts 25, 25 respectively project from the upper end surface of the side wall 21*a* into a claw shape at two places of the front end part and the back end part of the side wall 21*a* and lock the partition wall 11 while the opening at the side of the terminal setting surface 20S of the divided main body 24*a* is blocked up.

Each of the locking claw parts 25, 25 has a standing wall part 25*a* which has a width substantially equal to the plate thickness of the partition wall 11 and which stands upward from the upper end surface of the side wall 21*a*, and a claw part 25*b* which projects from the standing wall part 25*a* toward the inner side of the side wall 21*a* to be bent at a substantially right angle.

The two locking projections 26, 26 are provided to respectively project from bottom surfaces of two recessed parts 27, 27 formed on the side surface of the side wall 21*a* so that the two locking arms 28, 28 are fitted.

The second divided terminal accommodating part 20B, is provided with the two locking arms 28, 28 at the side wall 21*b* to which the hinge part 12 is not connected, among the pair of side walls 21*b*, 21*b* of the divided main body 24*b*.

The two locking arms 28, 28 respectively project, into a plate form from the upper end surface of the side wall 21*b*, and engage with the two locking projections 26, 26 of the first divided terminal accommodating part 20A.

Each of the locking arms 28, 28 has a plate-like part 28*a* which projects into a plate form from the upper end surface of the side wall 21*b*, and a projection fitting opening 28*b* which the plate-like part 28*a* is formed with and into which the locking projection 26 may be fitted.

Each of the divided terminal accommodating parts 20, as shown in FIG. 6 is formed with a planar portion 29 on the outside surfaces of the bottom walls 23*a*, 23*b*. While the two divided terminal accommodating parts 20 are divided, the planar portions 29 of the divided terminal accommodating parts 20 carry the inner housing 10 on a plane such as a work table. Thus, as shown in FIGS. 4A and 4B, while the terminal setting surfaces 20S of the divided terminal accommodating parts 20 are faced in the same direction, the partition wall 11 is held in a substantially upright state relative to the terminal setting surfaces 20S.

The terminal accommodating rooms 30 are sectioned by the pair of side walls 21*a*, 21*b* which form the divided main bodies 24*a*, 24*b*, the front end walls 22*a*, 22*b*, the bottom walls 23*a*, 23*b*, partition walls 31 that section accommodating spaces formed by these divided main bodies 24*a*, 24*b* into two terminal accommodating rooms 30, and the partition wall 11 which blocks up the openings at the sides of the terminal setting surfaces 20S of the divided terminal accommodating parts 20 with two sides.

Therefore, while the openings at the sides of the terminal setting surfaces 20S of the divided terminal accommodating parts 20 are not blocked up by the partition wall 11, openings which continue from the inner sides of the front end walls 22*a*, 22*b* of the walls forming the terminal accommodating rooms 30 to the electric wire insertion ports 30*b* become the terminal setting openings 30*a*.

The front end walls 22*a*, 22*b* are formed with two terminal insertion openings 13, into which male terminals (not shown) of the mating connector 100 are inserted, at positions corresponding to the inner terminals 40 accommodated in the terminal accommodating rooms 30.

As shown in FIGS. 4A, 4B, 7A and 7B, the terminal accommodating rooms 30 are provided with the primary locking projections 32 which project from the side walls 21*a*, 21*b* or the partition walls 31.

The primary locking projections 32 prevent that the inner terminals 40 accommodated inside the terminal accommodating rooms 30 rise from the terminal setting openings 30*a* and are removed from the terminal accommodating rooms 30 by being abutted against the inner terminals 40.

These primary locking projections 32 project to interfere with upper end edge surfaces 43*a* of the tying parts 43 of the inner terminals 40 while the inner terminals 40 are accommodated in the terminal accommodating rooms 30, and prevent that the inner terminals 40 rise from the terminal accommodating rooms 30 and are removed from the terminal insertion openings 13.

More specifically the primary locking projections 32 are formed with abutting surfaces 32*b* which face the upper end edge surfaces 43*a* of the tying parts 43 of the inner terminals 40 accommodated in the terminal accommodating rooms 30 and prevent the inner terminals 40 from rising by abutting against the upper end edge surfaces 43*a*.

The primary locking projections 32 are formed, on the surfaces at the sides of the terminal insertion openings 13, with terminal guiding surfaces 32*a* which are inclined to easily guide the inner terminals 40 from the terminal insertion openings 13 into the terminal accommodating rooms 30.

Therefore, the inner terminals 40 easily pass over the primary locking projections 32 along the terminal guiding surfaces 32*a* from the terminal insertion openings 13, and are accommodated in the terminal accommodating rooms 30.

The partition wall 11 has a board-like wall main body 11*a* and four secondary locking projections 11*b* for preventing the inner terminals 40 from being removed from the electric wire insertion ports 30*b*.

The wall main body 11*a* has a rectangular shape capable of blocking the opened terminal setting surfaces 20S of the two divided terminal accommodating parts 20 with the front and back surfaces.

The four secondary locking projections 11*b* prevent the inner terminals 40 accommodated in the four terminal accommodating rooms 30 from being removed from the electric wire insertion ports 30*b* into which the electric wires 80 are inserted while the two divided terminal accommodating parts 20 are combined by being abutted against the inner terminals 40.

The secondary locking projections 11*b* are termed with abutting surfaces 11*bb* which prevent the inner terminals 40 accommodated in the terminal accommodating rooms 30 from moving to be removed from the electric wire insertion ports 30*b* by being abutted against the inner terminals 40.

The abutting surfaces 11*bb* are surfaces which are placed to face end surfaces 41*a* of the mating terminal connecting parts 41 of the inner terminals 40 accommodated in the terminal accommodating rooms 30, or more specifically, the end surfaces 41*a* which face the electric wire insertion ports of the mating terminal connecting parts 41.

Two of the secondary locking projections 11*b* are provided on each of the front and back surfaces of the wall main body 11*a*, corresponding to the positions of the inner terminals 40 accommodated in the respective terminal accommodating rooms 30 of the two divided terminal accommodating parts 20.

The outer terminal 50 is a terminal which covers the outer periphery of the inner housing 10, and is connected to the exposed web 72 of the shielded electric wire 70, and is formed into a predetermined shape by, for example, pressing a board-like metal member.

This outer terminal 50 has an outer terminal body 51 which becomes a part covering the outer periphery of the inner housing 10, and a shield crimping part 52 which is a part crimped to the web 72 of the shielded electric wire 70.

The outer terminal body 51 has a substantially rectangular pipe shape corresponding to the outer shell of the inner housing 10, and is adapted that the inner housing 10 is locked to a predetermined position in the pipe. The outer terminal body 51 is adapted to be electrically connected to the male terminal to be described below of the mating connector 100.

The shield crimping part 52 is connected to the outer terminal main body 51 at the bottom wall through a connecting part which continues to the bottom wall of the outer terminal main body 51, and is so provided that a pair of barrel pieces 52*a* stand from both sides of the bottom wall.

The connector housing 60 is made of an insulating resin material, and has a hood part 61 which is formed into a hood shape to surround the outer periphery of the outer terminal 50, a sealing member holding accommodating part 62 which holds and accommodates a sealing member S for sealing an electric wire drawing-out port 60*a*, and a locking arm part 63 which locks a locked part 111 which a connector part 110 to be described below of the mating connector 100 is provided with.

For such a connector housing 60, the outer terminal 50 of the shielded electric wire 70 to which the inner terminals 40 and the outer terminal 50 are mounted are accommodated in the hood part 61, and the sealing member S is set in the sealing member holding accommodating part 62, and a rear holder 64 is mounted from the side of the electric wire drawing-out port 60*a*.

The mating connector 100, as shown in FIGS. 3A and 3B, has a connector part 110 which becomes a portion which is engaged with the shielded connector 1, and a camera accommodating part 120 which becomes a portion in which a camera function part (not shown) is accommodated.

The connector part 110 has a pipe shape, and a plurality of male terminals (not shown) connected to the inner terminals 40 are held and accommodated in the connector part 110 to direct the distal end toward a fitting opening. This connector part 110 is provided with the locked part 111 which the locking arm part 63 of the connector housing 60 locks.

The camera accommodating part 120 has a component attaching part 121 to attach a camera function part, and a camera cover part 122 which surrounds the component attaching part 121, and is provided with a lens 122*a*.

Then, an assembling procedure of the shielded connector 1 is described by using FIGS. 8A to 10C.

Figure 9A:
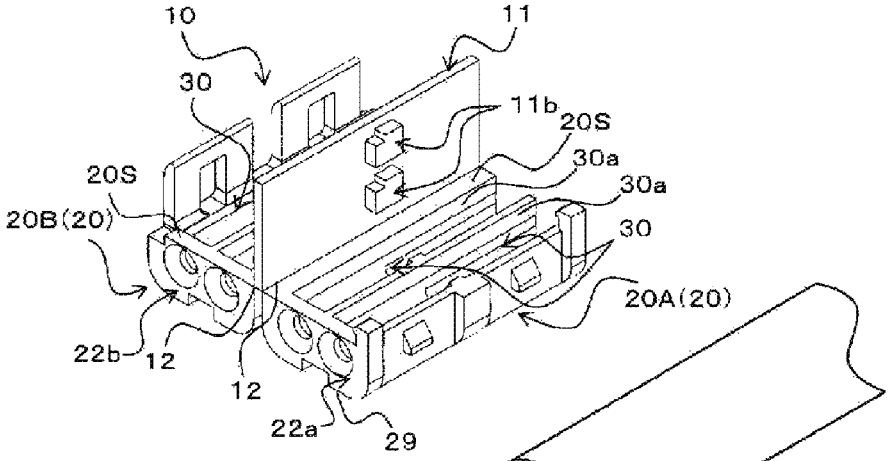
FIGS. 9A to 9C includes figures which show procedures until the inner terminals of the four inner terminals, which are attached to the terminal parts of the four electric wires, are accommodated respectively in the four terminal accommodating parts of the inner housing in a divided state.
Figure 9B:
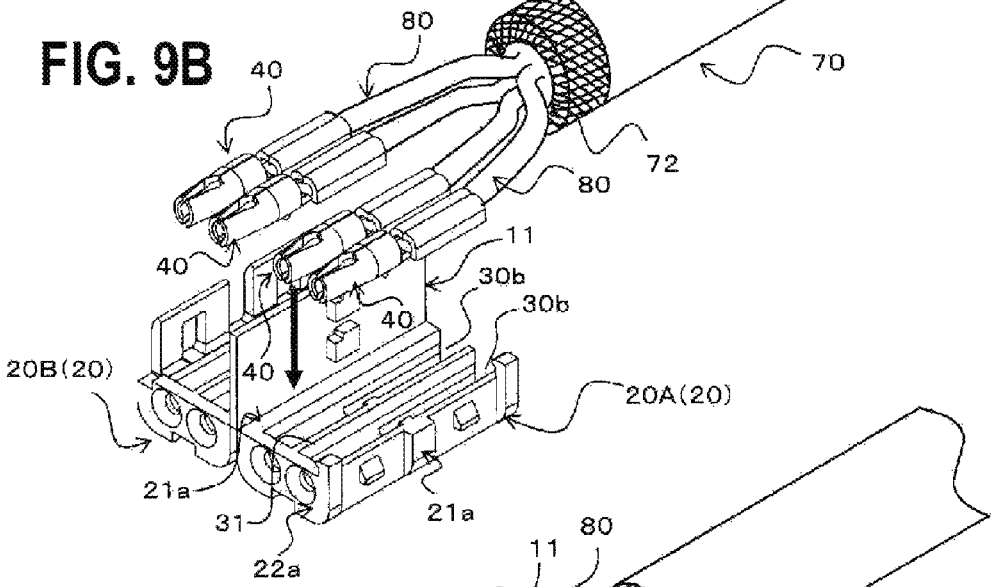
Figure 9C:
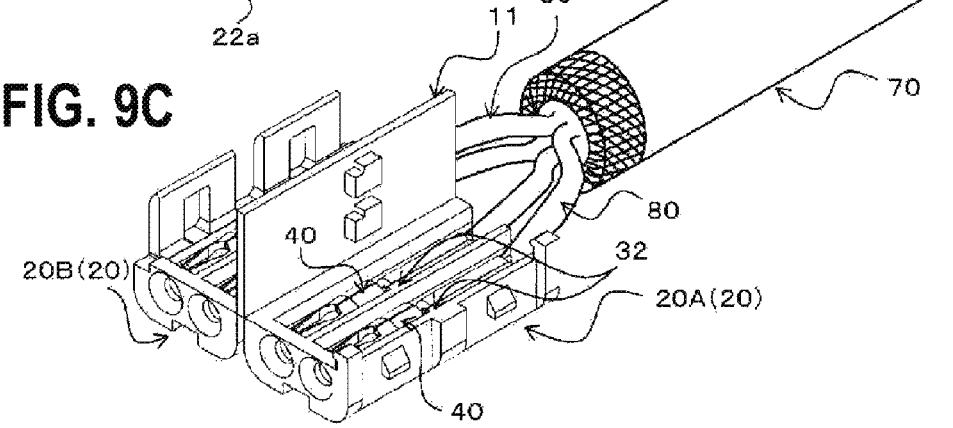
Figure 10A:
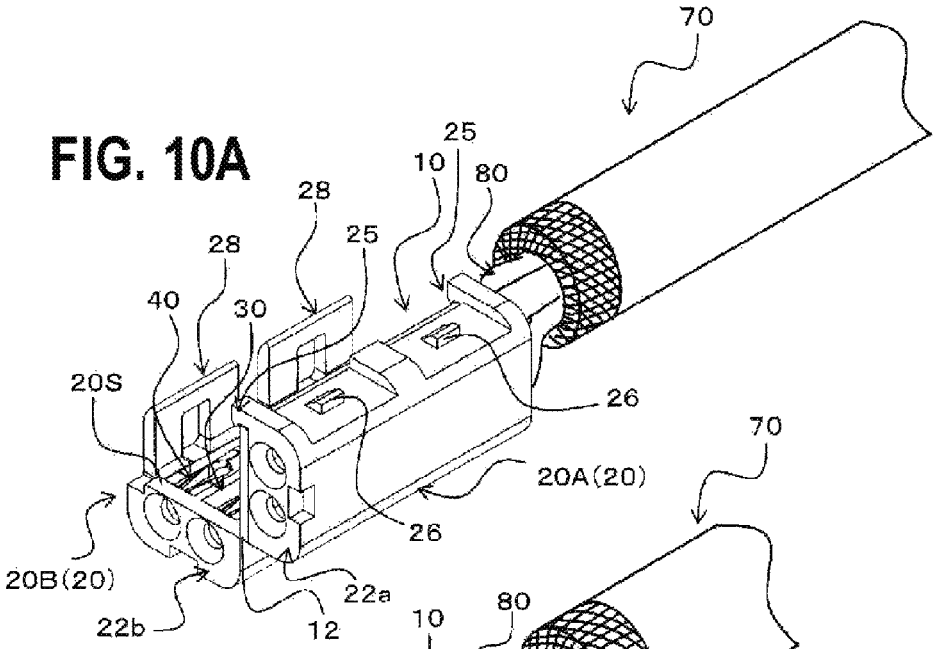
FIG. 10A is a figure which shows that a first divided terminal accommodating part is rotated toward a standing partition wall and the partition wall is locked with two locking claw parts while openings at the sides of terminal setting surfaces are blocked up.
Figure 10B:
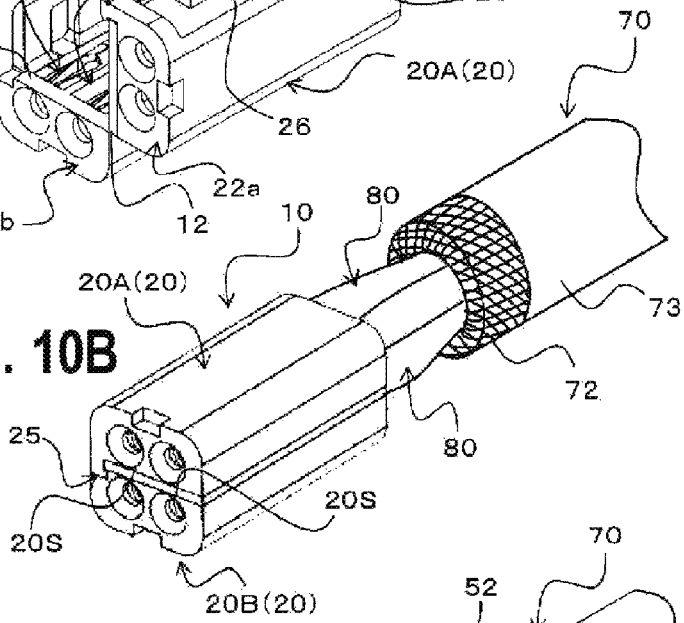
FIG. 10B is a figure which shows that the inner housing is completed in a combined state.
Figure 10C:
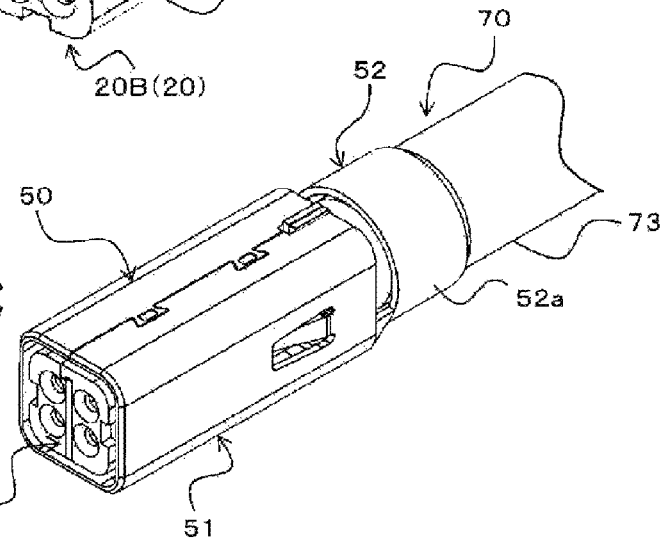
FIG. 10C is a figure which shows that the inner housing has been locked to a predetermined position in an outer terminal body of an outer terminal.

FIGS. 8A to 8F are figures to describe works of attaching the inner terminals 40 to the electric wires 80 of the shielded electric wire 70. FIGS. 9A to 9C include figures which show procedures until the inner terminals 40 of the four inner terminals 40, which are attached to the terminal parts of the four electric wires 80, are accommodated respectively in the four terminal accommodating parts 30 of the inner housing 10 in a divided state. FIG. 10A is a figure which shows that the first divided terminal accommodating part 20A is rotated toward the standing partition wall 11 and the partition wall 11 is locked with the two locking claw parts 25, 25 while openings at the sides of the terminal setting surfaces 20S are blocked up, FIG. 10B is a figure which shows that the inner housing 10 is completed in a combined state, and FIG. 10C is a figure which shows that the inner housing 10 has been locked to a predetermined position in the outer terminal body 51 of the outer terminal 50.

At first, a worker attaches the inner terminals 40 to the electric wires 80 of the shielded electric wire 70.

Figure 8A:
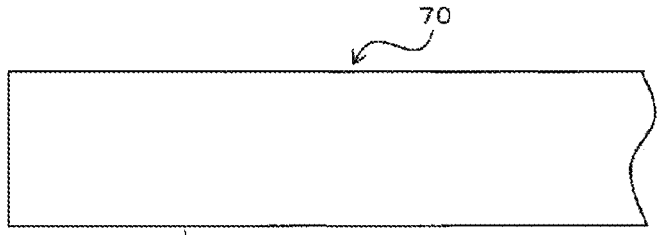
FIGS. 8A to 8F are figures to describe works of attaching the inner terminals to the electric wires of the shielded electric wire.
Figure 8B:
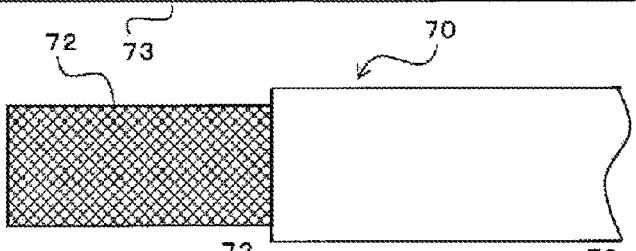
Figure 8C:
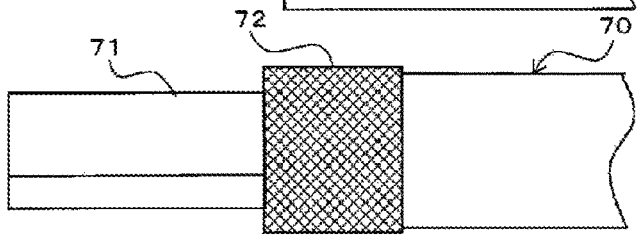
Figure 8D:
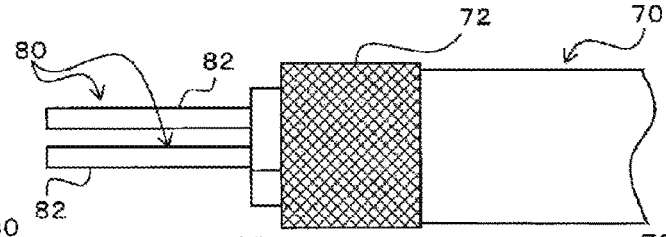
Figure 8E:
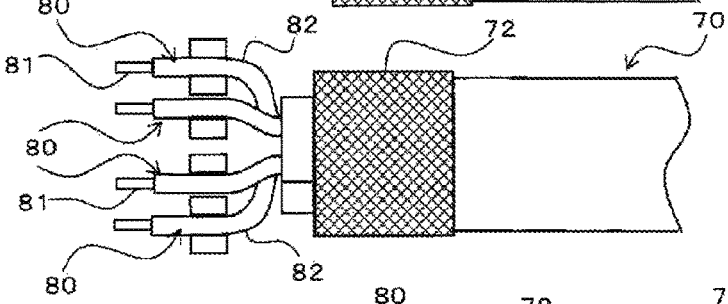
Figure 8F:
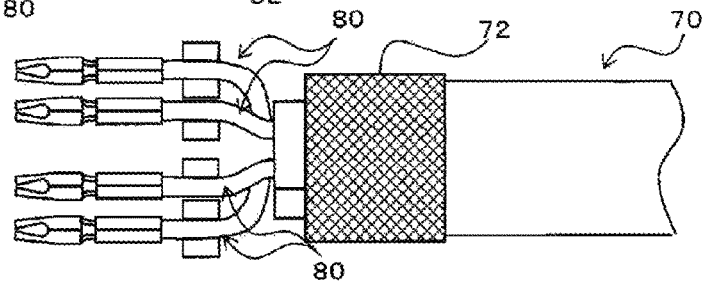

Here, the worker removes the insulating coating material 73 of the terminal part of the shielded electric wire 70 (refer to FIG. 8A), folds the exposed web 72 to overlap the outer periphery of the insulating coating material 73 (refer to FIGS. 8B and 8C), removes the exposed metal foil 71 so that the electric wires 80 are exposed (refer to FIGS. 8C and 8D), removes insulating coating materials 82 of the terminal parts of the four exposed electric wires 80 and exposes conductor parts 81 (refer to FIG. 8E), and attaches the inner terminals 40 to terminal parts of the four electric wires 80 (refer to FIG. 8F).

Then, the worker accommodates the inner terminals 40 attached to the terminal parts of the four electric wires 80 respectively in the four terminal accommodating parts of the inner housing 10 in a divided state (refer to FIGS. 9A to 9C).

The worker places the divided inner housing 10 on a plane such as a work table, with the flat surface portions of the bottom walls 23*a*, 23*b* of the divided terminal accommodating parts 20 as a placement surface.

Thereby, for the divided terminal accommodating parts 20, the partition wall 11 stands up against the terminal setting surfaces 20S while the terminal setting surfaces 20S are faced in the same direction, and the four terminal accommodating rooms 30 are placed in such a way that the terminal setting openings 30*a* are aligned in a row (refer to FIG. 9A).

Therefore, the four inner terminals 40 can be set in the terminal accommodating rooms 30 from one direction in which the terminal setting surfaces 20S are directed.

Because the terminal setting surfaces 20S of the divided terminal accommodating parts 20 are still in an open state of not being blocked by the partition wall 11, and because the terminal setting openings 30*a* of the terminal accommodating rooms 30 are continuously opened from the front end walls 22*a*, 22*b* to the electric wire insertion ports 30*b*, it is possible to easily set the inner terminals 40 in the terminal accommodating rooms 30 only by slightly bending the electric wire 80.

The inner terminals 40 accommodated in the terminal accommodating rooms 30 in this way are prevented by the primary locking projections 32 from rising to the side of the terminal setting openings 30*a* from inside the terminal accommodating rooms 30 and being removed from the terminal setting openings 30*a*.

Therefore, in the following assembling work, even if the divided terminal accommodating parts 20 are moved through the hinge parts 12 while the sides of the terminal setting surfaces 20S are opened, the inner terminals 40 are held stably in the accommodating rooms 30.

Then, the worker combines the inner housing 10 (refer to FIGS. 10A and 10B). The worker rotates the first divided terminal accommodating part 20A toward the standing partition wall 11 and locks the partition wall 11 with the two locking claw parts 25, 25 while the openings at the sides of the terminal setting surfaces 20S are blocked up (refer to FIG. 10A).

Then, by locking the first divided terminal accommodating part 20A and the second divided terminal accommodating part 20B with the two locking projections 26, 26 and the two locking arms 28, 28 while the partition wall 11 is locked, the two divided terminal accommodating parts 20 are combined.

In this way, when the two divided terminal accommodating parts 20 are combined, the openings at the sides of the terminal setting surfaces 20S of the divided terminal accommodating parts 20 are blocked by the front and back surfaces of the partition wall 11, and the terminal accommodating rooms 30 are insulated and isolated by the walls.

The inner terminals 40 are collectively locked in the terminal accommodating rooms 30 by the four secondary locking projections 11*b* which the front and back surfaces of the partition wall 11 are provided with so that the inner terminals 40 are prevented from being removed from the electric wire insertion ports 30*b*.

In this work, it is also possible to rotate the standing partition wall 11 toward the first divided terminal accommodating part 20A so that the partition wall 11 is locked by the two locking claw parts 25, 25 while the openings at the sides of the terminal setting surfaces 20S are blocked.

Then, the worker locks the inner housing 10 at a predetermined position in the outer terminal body 51 of the outer terminal 50 (refer to FIG. 10C). At this time, the worker performs a work of crimping the shield crimping part 52 of the outer terminal 50 to the exposed web 72 of the shielded electric wire 70 while the inner housing 10 is locked at the predetermined position in the outer terminal body 51.

Then, the worker accommodates the outer terminal 50 of the shielded electric wire 70 to which the inner terminals 40 and the outer terminal 50 are mounted in the hood part 61 of the connector housing 60, sets the sealing member S in the sealing member holding accommodating part 62, and finally mounts the rear holder 64 to the side of the electric wire drawing-out port 60*a* of the connector housing 60, so that the assembling work of the shielded connector 1 is completed.

For the two divided terminal accommodating parts 20 of the shielded connector 1 according to the embodiment of the present invention, the partition wall 11 stands up against the terminal setting surfaces 20S while the terminal setting surfaces 20S are faced in the same direction, and the four terminal accommodating rooms 30 are placed in such a way that the terminal setting openings 30*a* are aligned in a row. Thus, because the four inner terminals 40 can be set respectively in the terminal accommodating rooms 30 from one direction in which the terminal setting surfaces 20S are directed, the inner terminals 40 can be easily set in the terminal accommodating rooms 30 respectively only by slightly bending the four electric wires 80. As a result, productivity can be improved.

For the shielded connector 1 according to the embodiment of the present invention, the primary locking projections 32 are abutted against the inner terminals 40 to prevent that the inner terminals 40 accommodated inside the terminal accommodating rooms 30 rise from the terminal setting openings 30*a* and are removed from the terminal accommodating rooms 30. Thus, even if the divided terminal accommodating parts 20 are moved through the hinge parts 12 while the sides of the terminal setting surfaces 20S are opened, the inner terminals 40 can be held stably in the terminal accommodating rooms 30.

For the shielded connector 1 according to the embodiment of the present invention, while the two divided terminal accommodating parts 20 are combined, the inner terminals 40 accommodated in the four terminal accommodating rooms 30 are prevented from being removed from the electric wire insertion ports 30*b* of the terminal accommodating rooms 30 by the four secondary locking projections 11*b* which the partition wall 11 is provided with. Thus, even if an external force is burdened to pull the electric wires 80, the inner terminals 40 can be stably held in the terminal accommodating rooms 30. In addition, in a series of works of assembling the shielded connector 1 in which the two divided terminal accommodating parts 20 are combined, the inner terminals 40 can be collectively locked in the four terminal accommodating rooms 30 by the four secondary locking projections.

For the shielded connector 1 according to the embodiment of the present invention, because the terminal setting openings 30*a* are continuously opened from the inner sides of the front end walls 22*a* and 22*b* to the electric wire insertion ports 30*b*, the inner terminals 40 can be more easily set respectively in the terminal accommodating rooms 30 without bending the electric wires 80.

Although it is shown that the inner housing 10 of the shielded connector 1 according to the embodiment of the present invention has four terminal accommodating rooms 30, the number of the terminal accommodating rooms 80 which the inner housing 10 is provided with is not limited to four. The number may be a number corresponding to the number of the electric wires 80 which the shielded electric wire 70 has.

Although the shielded connector 1 according to the embodiment of the present invention is exemplified as applied to an in-vehicle camera, the present invention is not limited to this, but the shielded connector 1 may be applied to other devices.

The invention accomplished by the inventor is described in detail based on the above embodiment of the invention, but the present invention is not limited to the above embodiment of the invention and can be modified in various ways without departing from the spirit of the invention.

What is claimed is:

1. A shield connector comprising:

an inner housing that includes a plurality of terminal accommodating rooms to respectively accommodate inner terminals of a shield electric wire which is formed by bundling up a plurality of electric wires, of which the inner terminals are attached to terminal parts, and covering an outer periphery of the electric wires with a coating material including a shielding material and an insulating material; and an outer terminal into which the inner housing is mounted, wherein the inner housing is provided with the plurality of terminal accommodating rooms which are separated by a partition wall, and has two divided terminal accommodating parts which are connected in a combinable and dividable way by flexible hinge parts which are provided along edges of the partition wall, in a combined state of the two divided terminal accommodating parts, the two divided terminal accommodating parts hold the partition wall in between, and terminal setting surfaces, on which terminal setting openings for setting the inner terminals in the plurality of terminal accommodating rooms are overlapped through the partition wall so that the plurality of terminal accommodating rooms are sectioned by walls including the partition wall, and in a divided state of the two divided terminal accommodating parts, the partition wall stands up against the terminal setting surfaces while the terminal setting surfaces are faced in the same direction, and the plurality of terminal accommodating rooms containing the inner terminals are placed in such a way that the terminal setting openings are aligned in a row.

2. The shield connector according to claim 1, wherein the plurality of terminal accommodating rooms are provided with primary locking projections which abut on the inner terminal so as to prevent the inner terminals accommodated inside the terminal accommodating rooms from deviating from the terminal accommodating rooms through the terminal setting openings.

3. The shield connector according to claim 1, wherein the partition wall is provided with a plurality of secondary locking projections which abut on the inner terminals so as to prevent the inner terminals accommodated in the plurality of terminal accommodating rooms from being deviating from the electric wire insertion ports, into which the electric wires are inserted, of the terminal accommodating rooms while the two divided terminal accommodating parts are combined.

4. The shield connector according to claim 1, wherein the terminal setting openings are openings which continue from the inner sides of front end walls of walls forming the terminal accommodating rooms to the electric wire insertion ports into which the electric wires are inserted.

5. The shield connector according to claim 1, wherein at least one of the divided terminal accommodating parts includes at least one locking claw extending from a side wall of the divided accommodating part and, in the combined state, at least a portion of the locking claw overlaps a side wall of the partition wall and locks the divided accommodating part against the partition wall.

6. The shield connector according to claim 1, wherein one of the divided terminal accommodating parts includes at least one locking projection projecting from a side surface of the divided terminal accommodating part, the other one of the divided terminal accommodating parts includes at least one locking arm projecting from a side surface of the other of the divided terminal accommodating part, and in the combined state, each of the at least one locking arms fits over each of the corresponding at least one locking projections.

7. The shield connector according to claim 6, wherein the divided terminal accommodating part having the at least one locking projection further includes at least one locking claw extending from the side wall of the divided accommodating part and, in the combined state, at least a portion of the locking claw overlaps a side wall of the partition wall and locks the divided accommodating part against the partition wall.

* * * * *